US008957824B2

(12) United States Patent
Choi et al.

(10) Patent No.: US 8,957,824 B2
(45) Date of Patent: Feb. 17, 2015

(54) BROADBAND DIPOLE ANTENNA

(75) Inventors: Oh-Seog Choi, Hwaseong-si (KR); Young-Chan Moon, Suwon-si (KR); Heon-Jeong Jeong, Yongin-si (KR)

(73) Assignee: KMW Inc., Hwaeseong (KR)

( * ) Notice: Subject to any disclaimer, the term of this patent is extended or adjusted under 35 U.S.C. 154(b) by 411 days.

(21) Appl. No.: 13/391,237

(22) PCT Filed: Sep. 2, 2010

(86) PCT No.: PCT/KR2010/005981
§ 371 (c)(1),
(2), (4) Date: Feb. 17, 2012

(87) PCT Pub. No.: WO2011/028049
PCT Pub. Date: Mar. 10, 2011

(65) Prior Publication Data

US 2012/0146871 A1 Jun. 14, 2012

(30) Foreign Application Priority Data

Sep. 2, 2009 (KR) ..... 10-2009-0082639

(51) Int. Cl.
*H01Q 9/28* (2006.01)
*H01Q 21/26* (2006.01)

(52) U.S. Cl.
CPC ..... *H01Q 21/26* (2013.01)
USPC ..... 343/795; 343/797; 343/821

(58) Field of Classification Search
CPC ..... H01Q 21/26
USPC ..... 343/795, 797, 810, 820, 821
See application file for complete search history.

(56) References Cited

U.S. PATENT DOCUMENTS

| | | | | | |
|---|---|---|---|---|---|
| 3,740,754 | A * | 6/1973 | Epis | 343/797 |
| 4,081,803 | A * | 3/1978 | Dempsey | 343/795 |
| 4,218,685 | A * | 8/1980 | Frosch et al. | 343/727 |
| 5,173,715 | A * | 12/1992 | Rodal et al. | 343/795 |
| 6,034,649 | A * | 3/2000 | Wilson et al. | 343/795 |
| 6,069,590 | A * | 5/2000 | Thompson et al. | 343/795 |
| 7,132,995 | B2 | 11/2006 | Gottl | |
| 7,439,927 | B2 * | 10/2008 | Lenart et al. | 343/797 |
| 2005/0134517 | A1 | 6/2005 | Gottl | |
| 2008/0252530 | A1 | 10/2008 | Bae et al. | |

FOREIGN PATENT DOCUMENTS

| | | | |
|---|---|---|---|
| CN | 101222087 | A | 7/2008 |
| JP | 2001-313516 | A | 11/2001 |
| JP | 2003-309417 | A | 10/2003 |
| JP | 2007-006246 | A | 1/2007 |
| KR | 10-2006-0099061 | A | 9/2006 |
| KR | 1020060099061 | A | 9/2006 |
| KR | 10-0865749 | B1 | 10/2008 |
| KR | 10-2008-0105397 | A | 12/2008 |
| WO | 2009/080644 | A2 | 7/2009 |

* cited by examiner

*Primary Examiner* — Tho G Phan
(74) *Attorney, Agent, or Firm* — Mintz, Levin, Cohn, Ferris, Glovsky and Popeo, P.C.

(57) ABSTRACT

A broadband dipole antenna is provided, in which a radiator includes a plurality of radiation pattern units for transmitting and receiving a radio signal, the radiation pattern units have radiation patterns of resonators formed thereon, and a power supply and balun structure supports and supplies power to the radiator. Each of the plurality of radiation pattern units of the radiator has at least a dual radiation pattern structure having an inner radiation pattern and an outer radiation pattern.

7 Claims, 13 Drawing Sheets

BROADBAND DIPOLE ANTENNA

PRIORITY

This application is a National Stage application under 35 U.S.C. §371 of an International application filed on Sep. 2, 2010 and assigned application No. PCT/KR2010/005981, and claims the benefit under 35 U.S.C. §365(b) of a Korean patent application filed Sep. 2, 2009 in the Korean Intellectual Property Office and assigned application No. 10-2009-0082639, the entire disclosure of which is hereby incorporated by reference.

BACKGROUND OF THE INVENTION

1. Field of the Invention

The present invention relates to an antenna in a wireless communication system and more particularly, to a dipole antenna having broadband characteristics.

2. Description of the Related Art

Dual-polarization dipole antennas supporting polarization diversity have recently become popular. Basically, a dual-polarization dipole antenna has a dipole square. Research is being made on the dual-polarization antenna in order to satisfy broadband characteristics.

SUMMARY OF THE INVENTION

An aspect of embodiments of the present invention is to address at least the problems and/or disadvantages and to provide at least the advantages described below. Accordingly, an aspect of embodiments of the present invention is to provide a broadband dipole antenna which is readily matched to a raydome and has broadband characteristics.

Another aspect of embodiments of the present invention is to provide a broadband dipole antenna designed so as to facilitate control of desired impedance in a frequency band.

A further aspect of embodiments of the present invention is to provide a broadband dipole antenna which is easily fabricated and has a stable balun structure.

In accordance with an embodiment of the present invention, there is provided a broadband dipole antenna, in which a radiator includes a plurality of radiation pattern units for transmitting and receiving a radio signal, the radiation pattern units have radiation patterns of resonators formed thereon, and a power supply and balun structure supports and supplies power to the radiator. Each of the plurality of radiation pattern units of the radiator has at least a dual radiation pattern structure having an inner radiation pattern and an outer radiation pattern.

BRIEF DESCRIPTION OF THE DRAWINGS

The above and other objects, features and advantages of certain embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EMBODIMENTS OF THE INVENTION

Reference will be made to preferred embodiments of the present invention with reference to the attached drawings. While details such as specific components are given in the following description, it is to be clearly understood to those skilled in the art that the details are provided to help comprehensive understanding of the present invention and thus many modifications and changes can be made to them within the scope and spirit of the present invention.

Figure 1:
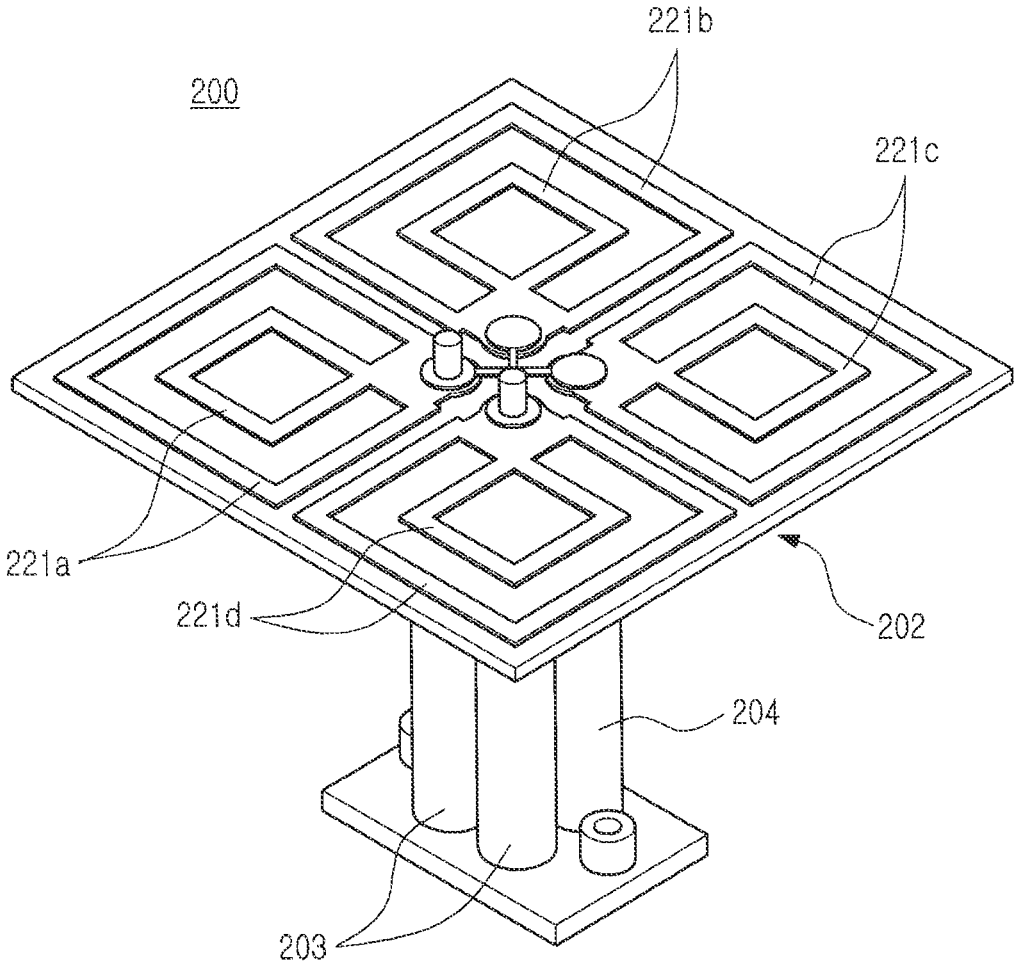
FIG. 1 is a perspective view of a broadband dipole antenna according to an embodiment of the present invention.
Figure 2:
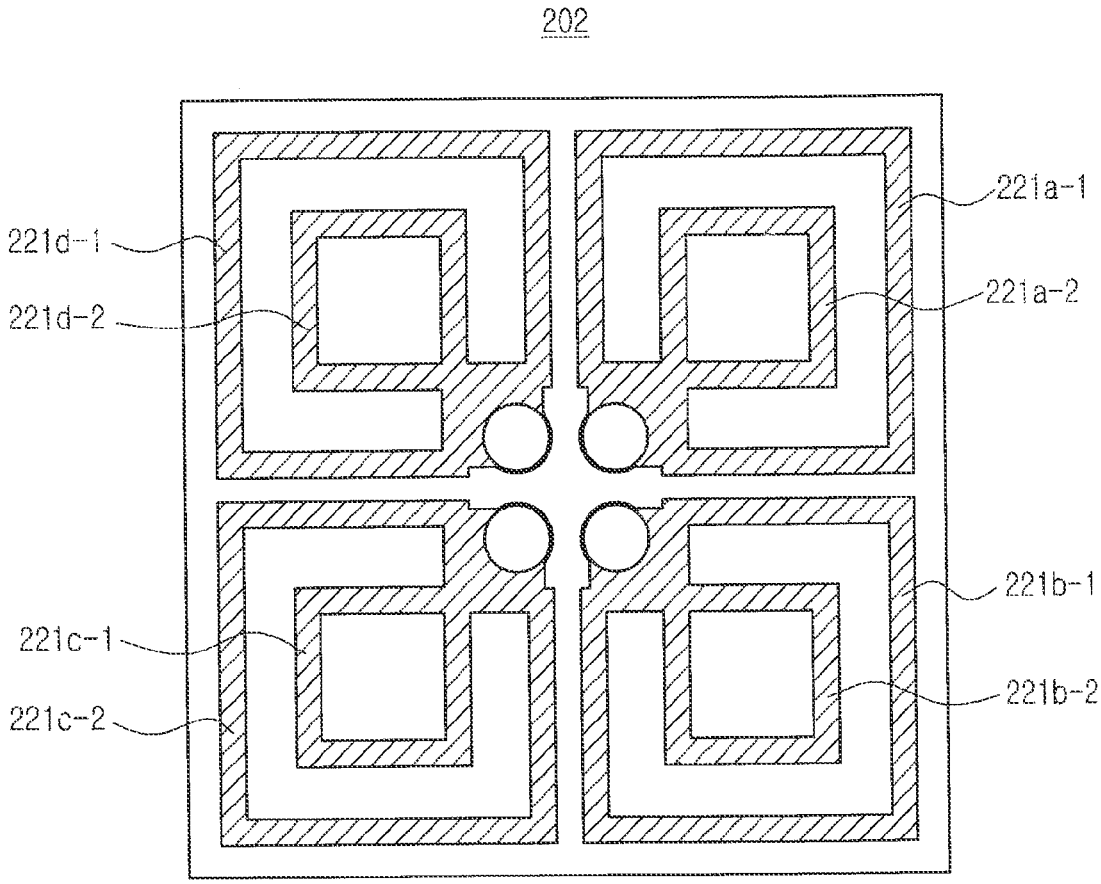
FIG. 2 is a plan view of a radiator illustrated in FIG. 1.
Figure 3:
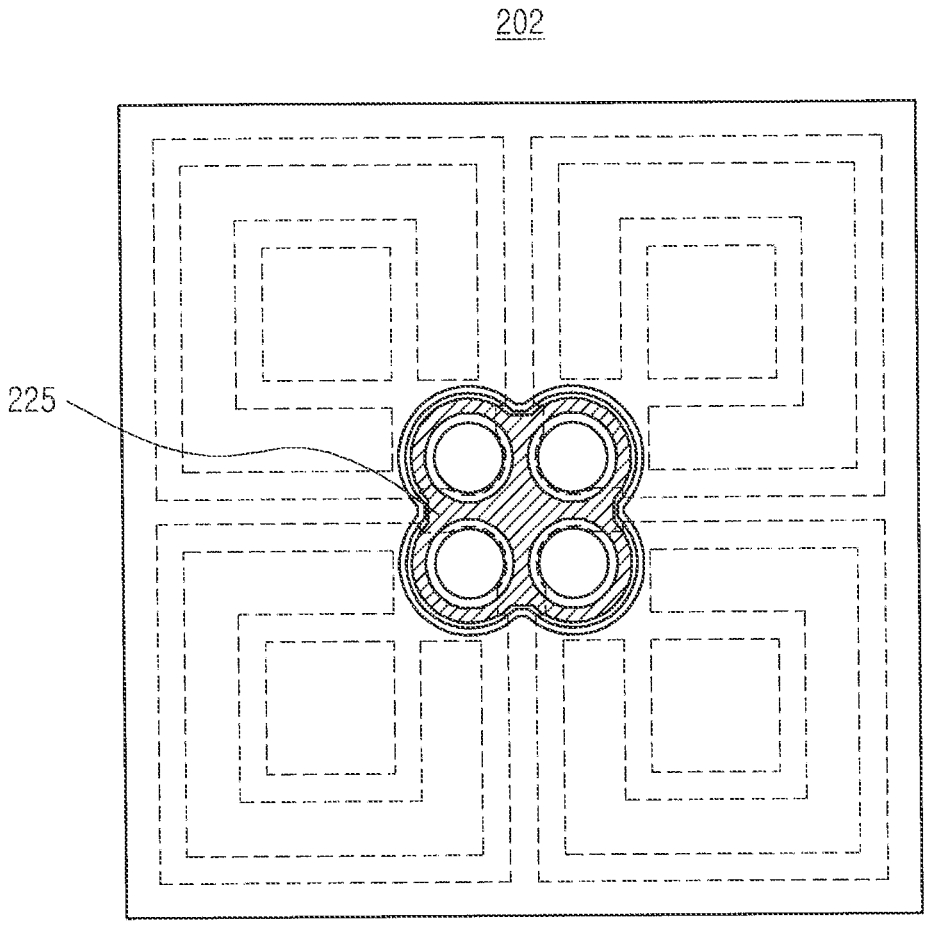
FIG. 3 is a rear view of the radiator illustrated in FIG. 1.

FIG. 1 is a perspective view of a broadband dipole antenna according to an embodiment of the present invention, FIG. 2 is a plan view of a radiator illustrated in FIG. 1, and FIG. 3 is a rear view of the radiator illustrated in FIG. 1. Referring to FIGS. 1, 2 and 3, like a conventional broadband dipole antenna, a broadband dipole antenna 200 according to the present invention includes a power supply cable 203 and a balun cable 204 mounted on a reflection plate (not shown), a radiator 202 on which a plurality of (first to fourth) radiation pattern units 221*a* to 221*d* are formed, having resonance patterns connected to the power supply cable 203 and the balun cable 204 in order to transmit and receive radio signals, and a metal air bridge for electrically connecting radiation pattern units connected to the power supply cable 203, that is, the first and fourth radiation pattern units 221*a* and 221*d* to radiation pattern units connected to the balun cable 204, that is, the second and third radiation pattern units 221*b* and 221*c*.

In the thus-constituted broadband dipole antenna 200 according to the present invention, each of the radiation pattern units 221*a* to 221*d* of the radiator 202 has a different resonator pattern from a conventional resonator pattern.

Compared to the conventional technology, the first to fourth radiation pattern units 221*a* to 221*d* of the radiator 202 are formed into radial patterns each having dual square rings, that is, inner and outer square rings. That is, the first radiation pattern unit 221*a* includes a square ring-shaped outer radiation pattern sub-unit 221*a*-1 and a smaller square ring-shaped inner radiation pattern sub-unit 221*a*-2 apart from the outer radiation pattern sub-unit 221*a*-1 by a predetermined distance inside the outer radiation pattern sub-unit 221*a*-1. Likewise, the second radiation pattern unit 221*b* includes an outer radiation pattern sub-unit 221*b*-1 and an inner radiation pattern sub-unit 221*b*-2, the third radiation pattern unit 221*c* includes an outer radiation pattern sub-unit 221*c*-1 and an inner radiation pattern sub-unit 221*c*-2, and the fourth radiation pattern unit 221*d* includes an outer radiation pattern sub-unit 221*d*-1 and an inner radiation pattern sub-unit 221*d*-2. The outer and inner radiation pattern sub-units of the first to fourth radiation pattern units 221*a* to 221*d* are connected to the power supply cable or the balun cable at the same positions.

The above-described radiation pattern units are designed to improve broadband characteristics according to the present invention. For example, since dual resonators each having a square radial pattern are used, the outer square radiation-pattern resonator generates low-frequency oscillation in a broad frequency band and the inner square radiation-pattern resonator generates high-frequency oscillation in the broad frequency band. The resulting combination of two resonant frequency bands gives broadband characteristics to the radiation pattern units.

Obviously, the length of the square radiation pattern of each resonator is determined according to 212 with respect to its resonant frequency. In addition, since the width of the square radiation pattern forms impedance, it may be increased to give broadband characteristics to the radiation patterns of the conventional radiation pattern units illustrated in FIGS. 1 and 2. However, the impedance is decreased in that case. By contrast, the dual radiation pattern structure of the radiation pattern units according to the present invention can be easily designed to have desired impedance in an associated frequency band and readily matched to a raydome by appropriately adjusting the widths of the outer and inner radiation patterns.

Referring to FIG. 3, a broadband compensation pad 225 of a predetermined area is formed at the center of the rear surface of the radiator 102. The broadband compensation pad 225 contributes to the increase of the bandwidth of the antenna. That is, the broadband compensation pad 225 compensates for the inductance component of the air bridge formed at a position corresponding to the broadband compensation pad 225 on the top surface of the radiator, thereby enhancing the broadband characteristics of the antenna. One thing to note herein is that the radiator 202 should be designed so as to electrically separate the broadband compensation pad 225 from the power supply cable 203 and the balun cable 204.

Figure 4:
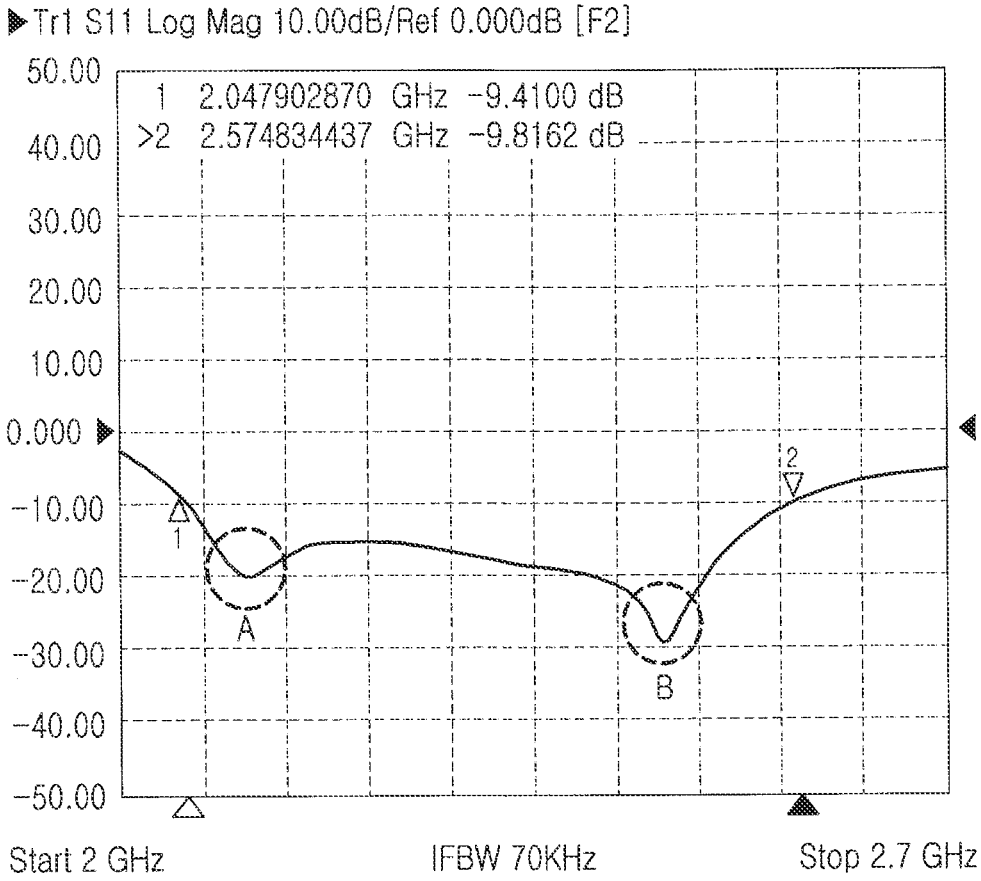
FIGS. 4 and 5 are graphs illustrating characteristics of the broadband dipole antenna illustrated in FIG. 1.
Figure 5:
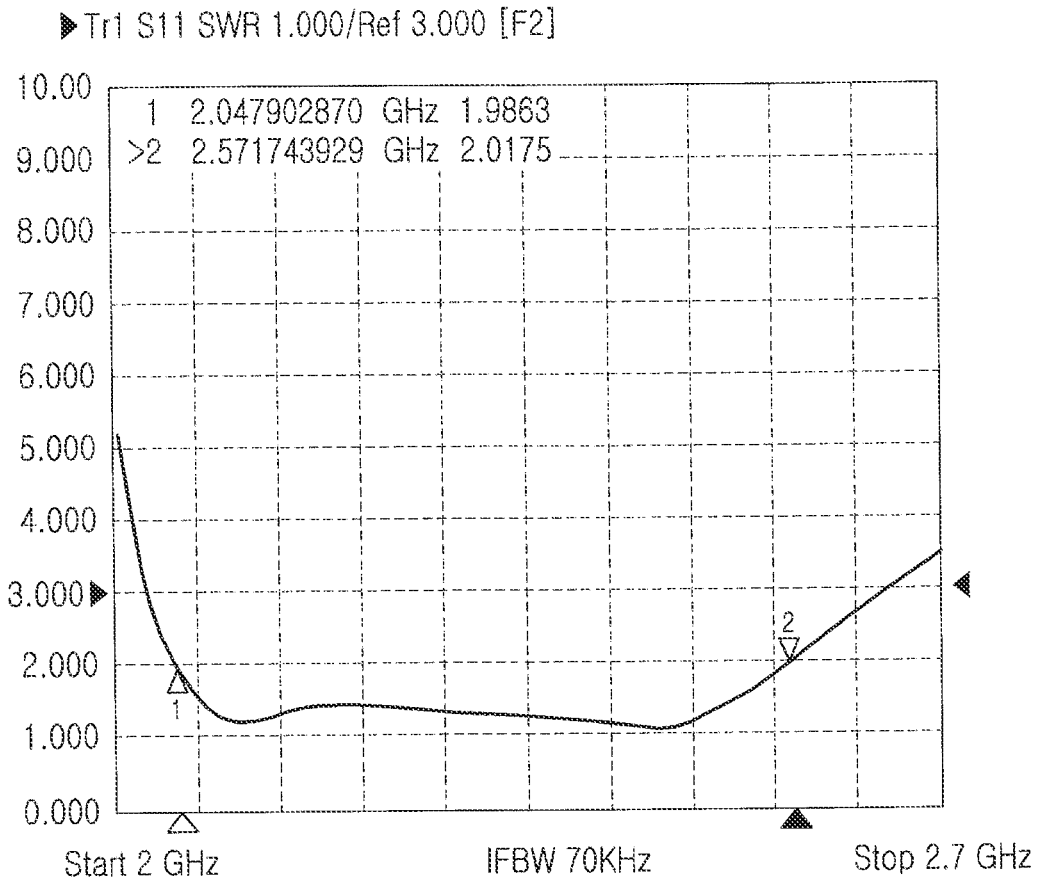

FIGS. 4 and 5 are graphs illustrating characteristics of the broadband dipole antenna illustrated in FIG. 1. Referring to FIGS. 4 and 5, resonant frequency bands generated by the resonators of the outer and inner square radiation patterns in the radiation pattern units of the present invention are marked by dotted circles A and B, respectively.

FIG. 5 illustrates exemplary Voltage Standing Wave Ratio (VSWRs) measurements in the case where the dipole antenna of the present invention is installed inside a spherical raydome under the same measurement conditions as applied to the conventional dipole antenna illustrated in FIG. 3. As noted from FIG. 5, the dipole antenna of the present invention has a bandwidth of about 2.05 to 2.57 GHz at 2 GHz, thus achieving broadband characteristics with a wider bandwidth, compared to the conventional dipole antenna.

Figure 6:
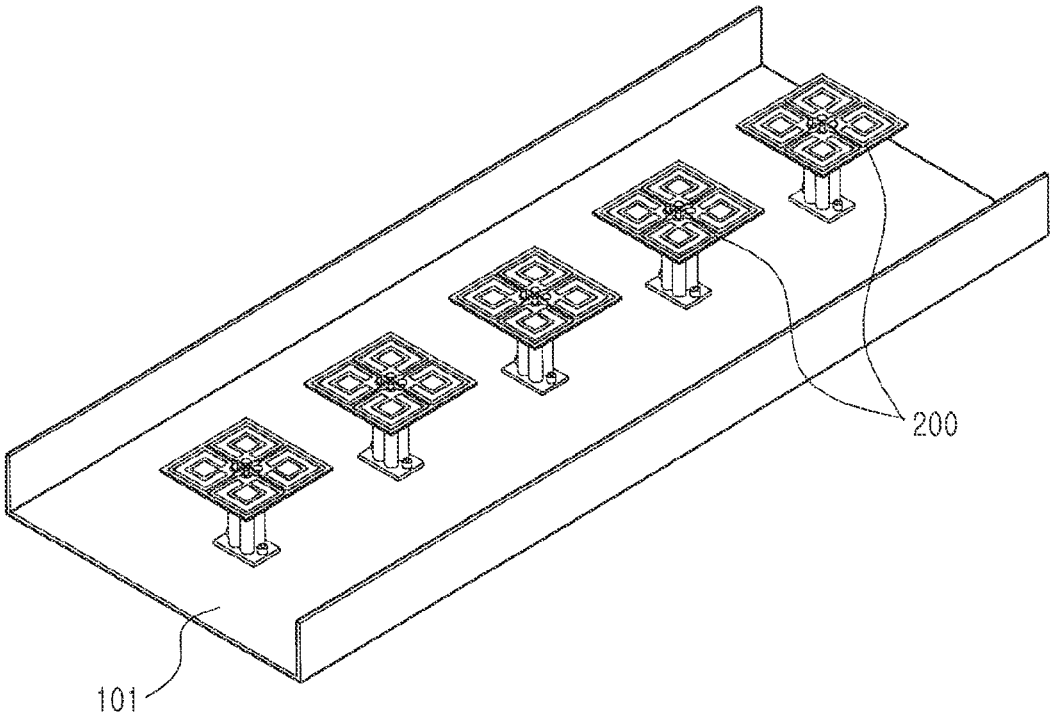
FIG. 6 illustrates an exemplary antenna device configured with broadband dipole antennas having the configuration illustrated in FIG. 1.

FIG. 6 illustrates an exemplary antenna device configured with broadband dipole antennas having the configuration illustrated in FIG. 1. Referring to FIG. 6, a single antenna device may be configured by vertically arranging a plurality of broadband dipole antennas 200 of the present invention in a row in a real use environment.

Figure 7:
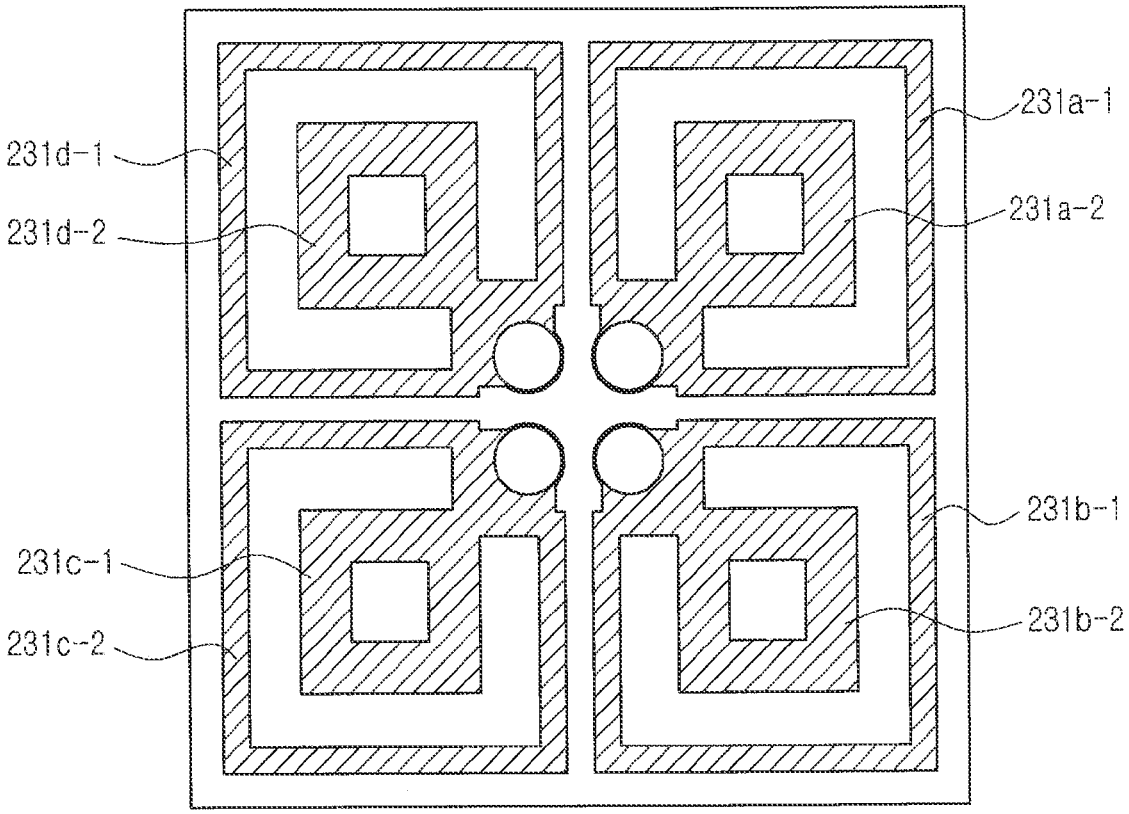
FIG. 7 illustrates an exemplary modification of the radiator illustrated in FIG. 1.

FIG. 7 illustrates an exemplary modification of the radiator illustrated in FIG. 1. Referring to FIG. 7, the dual radiation patterns of the radiation pattern units according to the present invention are formed in such a manner that inner radiation pattern sub-units 231*a*-2, 231*b*-2, 231*c*-2, and 231*d*-2 are wider than outer radiation pattern sub-units 231*a*-1, 231*b*-1, 231*c*-1, and 231*d*-1. As the outer and inner sub-radiation patterns are formed to be wider or narrower in this manner, the broadband dipole antenna of the present invention can be readily designed so as to achieve desired impedance in a frequency band.

Figure 8:
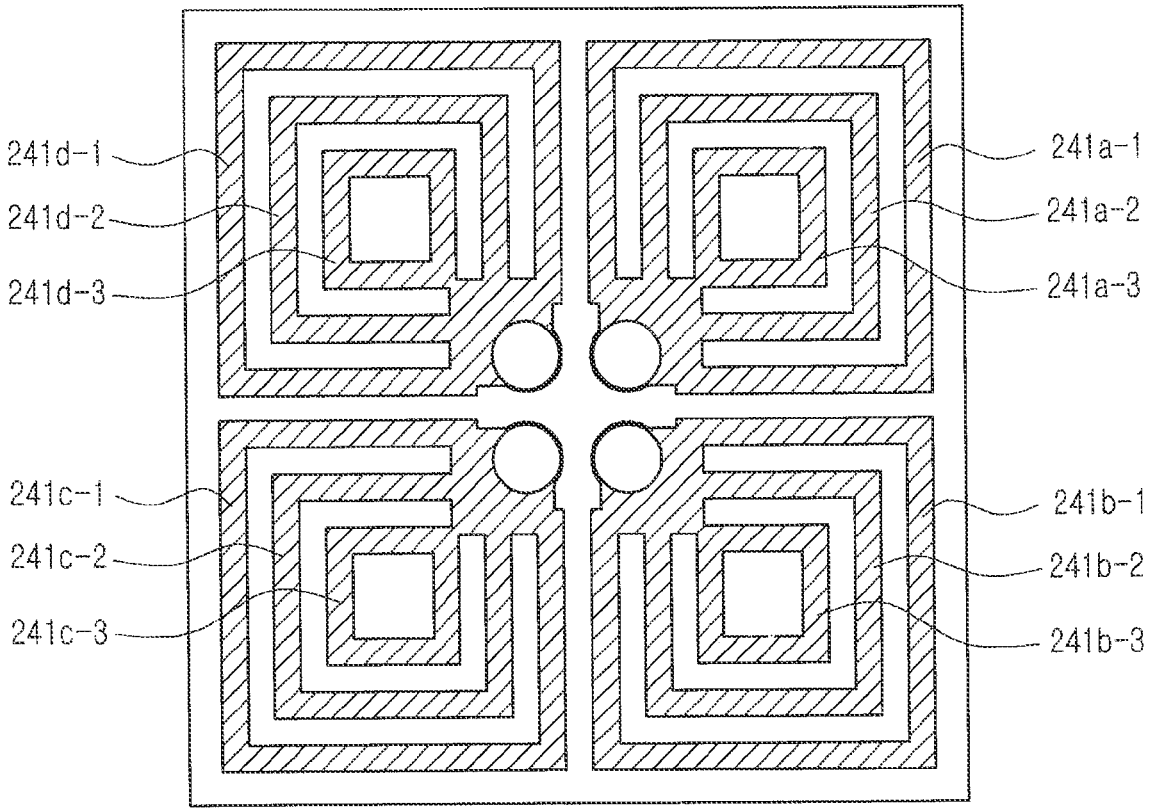
FIG. 8 illustrates another exemplary modification of the radiator illustrated in FIG. 1.

FIG. 8 illustrates another exemplary modification of the radiator illustrated in FIG. 1. Referring to FIG. 8, each of the radiation patterns units of the present invention has a triple radiation pattern structure, not a dual radiation pattern structure. That is, the radiation pattern units of the present invention include outer radiation pattern sub-units 241*a*-1, 241*b*-1, 241*c*-1, and 241*d*-1, first inner radiation pattern sub-units 241*a*-2, 241*b*-2, 241*c*-2, and 241*d*-2, and second inner radiation pattern sub-units 241*a*-3, 241*b*-3, 241*c*-3, and 241*d*-3. According to this radiation pattern structure, the radiation pattern units of the present invention resonate middle frequency bands in a broad band through the first inner radiation pattern sub-units 241*a*-2, 241*b*-2, 241*c*-2, and 241*d*-2, thereby compensating for a gain decrease that may occur in the middle part of the broad band. As described above, the radiation pattern units of the present invention may be configured into a dual, triple, or higher structure.

Figure 9:
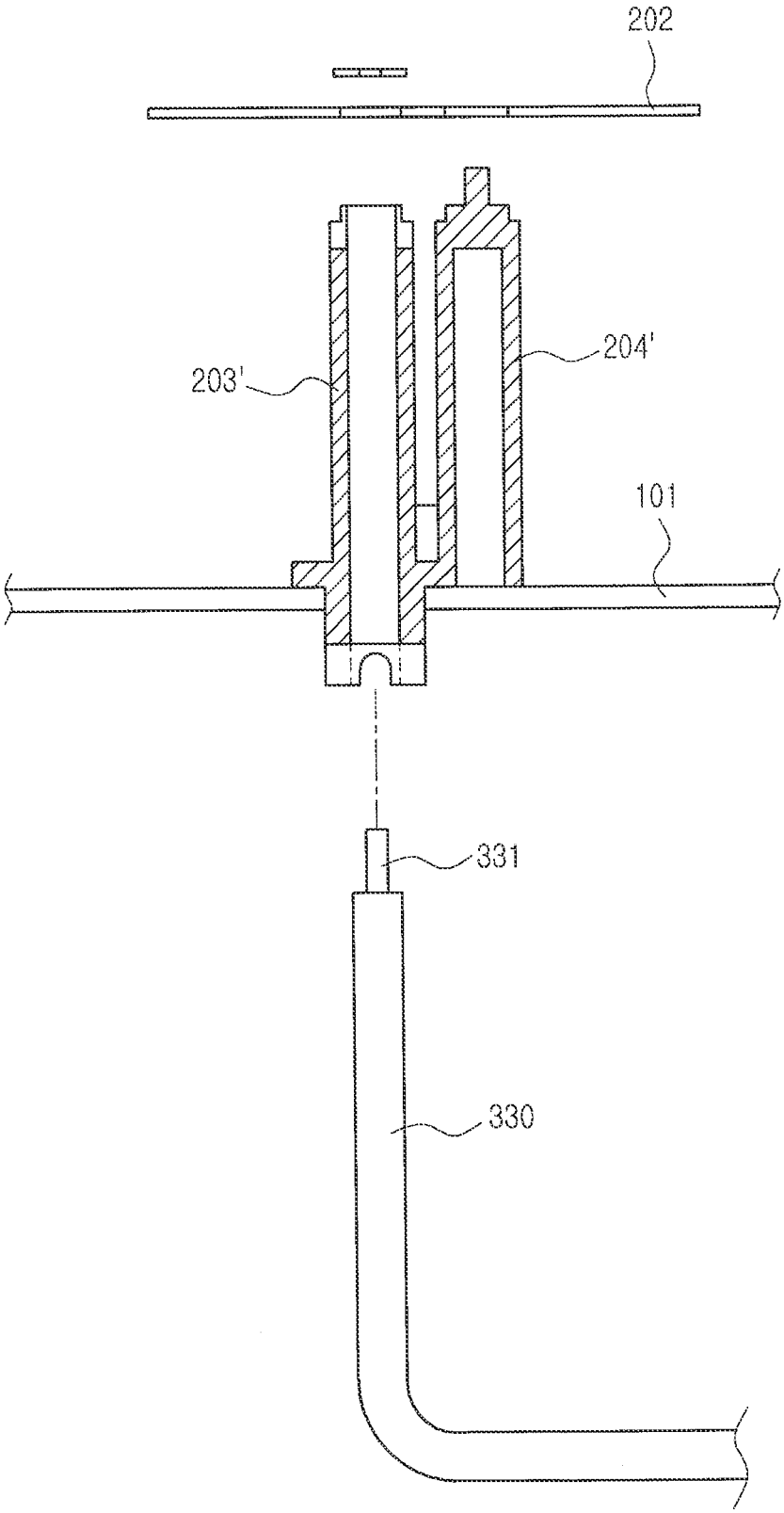
FIGS. 9 and 10 illustrate an exemplary power supply and balun structure for the broadband dipole antenna according to an embodiment of the present invention.
Figure 10:
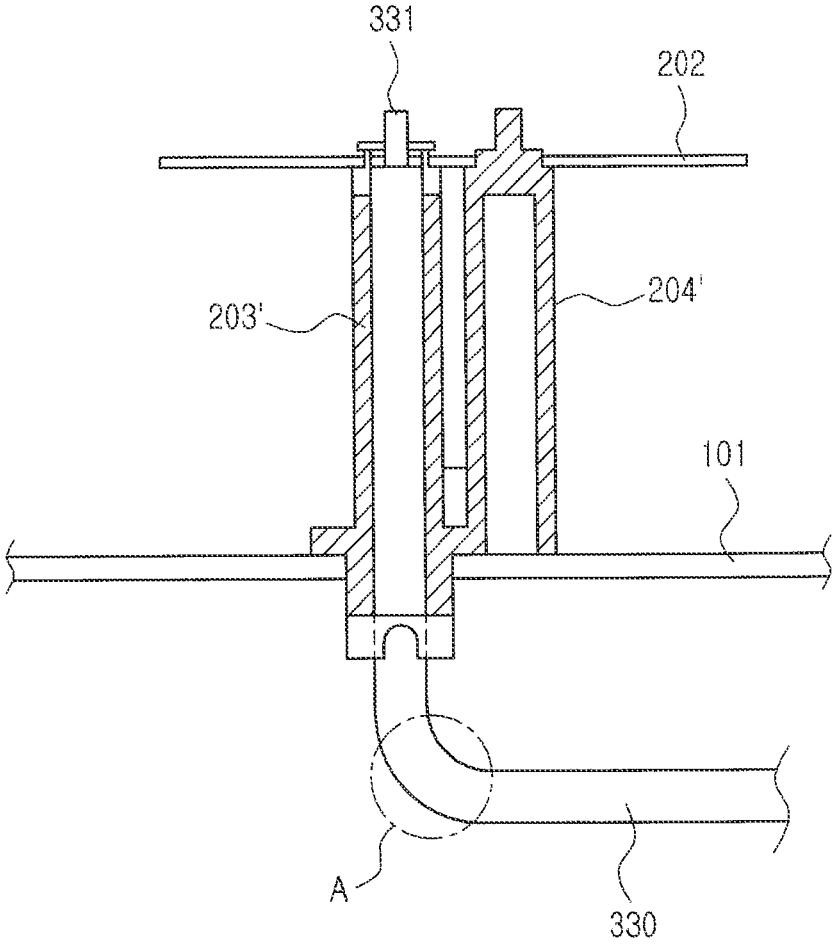

FIGS. 9 and 10 illustrate an exemplary power supply and balun structure for the broadband dipole antenna before and after the radiator 202 is assembled according to an embodiment of the present invention. Referring to FIGS. 9 and 10, a metal power supply support 203'/balun support 204' may be installed to balance the power supply cable and the balun cable for a long time, to thereby prevent damage to the power supply cable and the balun cable and ensure the lifetime of the antenna in an embodiment of the present invention.

The power supply support 203'/balun support 204' may be formed by integrally connecting lower portion of four pipes each having a diameter equal to that of the power supply cable 330. A lower portion of the power supply support 203'/balun support 204' is fixed to a reflection plate 101 by, for example, a screw, and an upper portion of the power supply support 203'/balun support 204' shaped into four pipes is electrically connected to the radiation pattern units of the radiator 202.

Therefore, the power supply cable 330 may be simply inserted into the power supply support 203'. In addition, the balun support 204' itself functions as a conventional balun cable, which obviates the need for any other part inside the balun support 204'.

Figure 11:
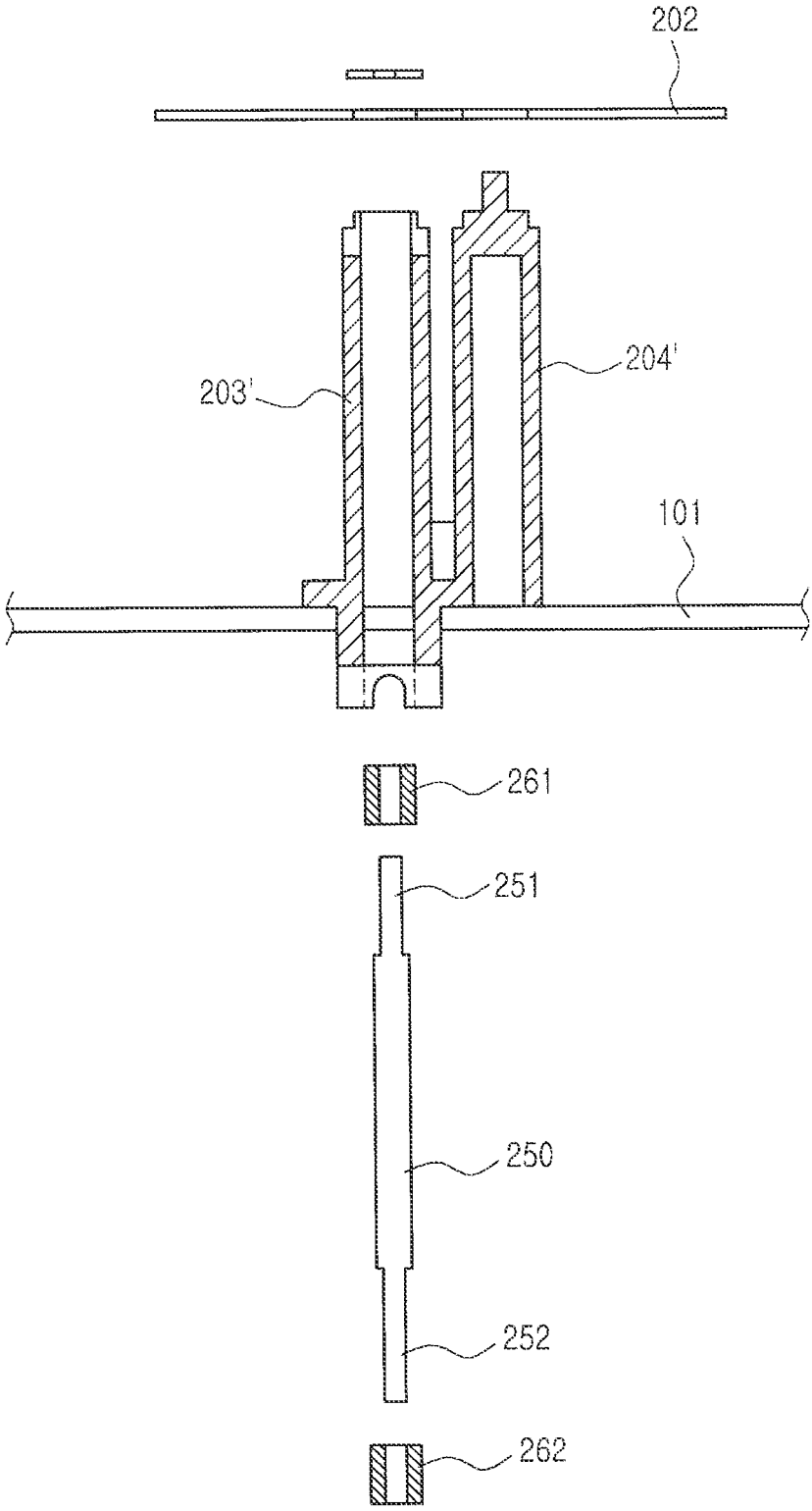
FIGS. 11, 12 and 13 illustrate another exemplary power supply and balun structure for the broadband dipole antenna according to another embodiment of the present invention.
Figure 12:
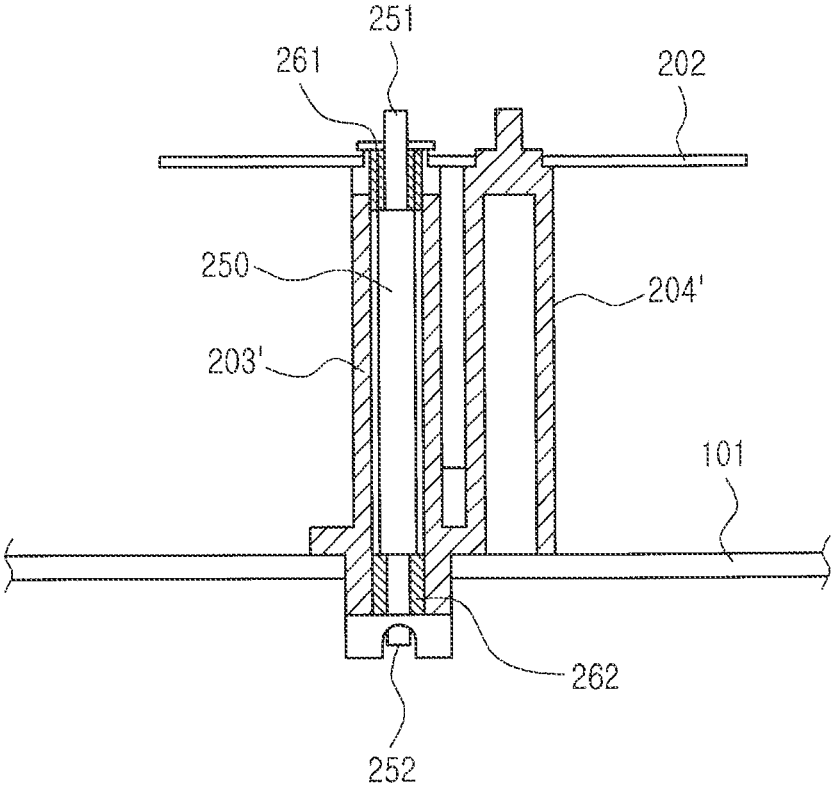
Figure 13:
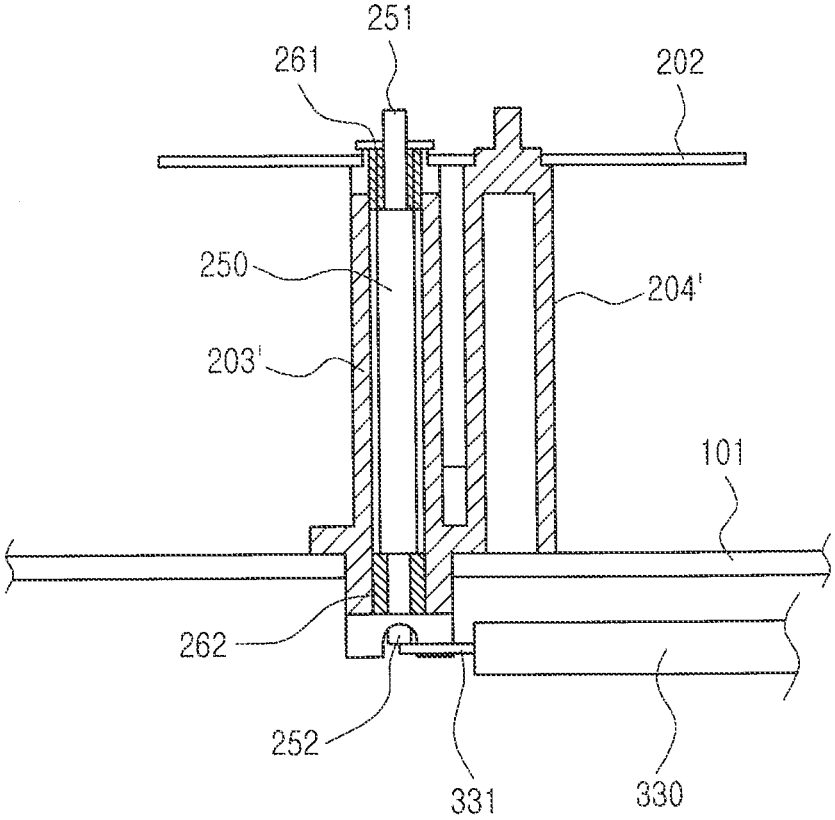

FIGS. 11, 12 and 13 illustrate an exemplary power supply and balun structure for the broadband dipole antenna according to another embodiment of the present invention. FIGS. 11 and 12 illustrate the power supply and balun structure before and after the radiator 202 is assembled and FIG. 13 illustrates the power supply and balun structure connected to the power supply cable. Referring to FIGS. 11, 12 and 13, the power supply and balun structure includes the power supply support 203'/balun support 204' of the same structure as illustrated in FIGS. 9 and 10 and an auxiliary power supply device connected to the power supply cable 330 at one end thereof and to the radiator 202 (the air bridge on the radiator 202 in real implementation) at the other end thereof inside the power supply support 203', for forming a power supply path.

The auxiliary power supply device may include an auxiliary power supply pin 250 connected to the power supply cable 330 at one end thereof and to the radiator 202 at the other end thereof inside the power supply support 203', for forming a power supply path and auxiliary rings 261 and 262 formed of a material such as Teflon, for supporting the auxiliary power supply pin 250 and isolating the auxiliary power supply pin 250 from the inner surface of the power supply support 203'. Herein, the diameter of the auxiliary power supply pin 250 is smaller at both ends thereof than at the remaining part. The auxiliary rings 261 and 262 are configured in such a manner that their outer diameters are equal to the inner diameter of the power supply support 203' and their inner diameters are equal to the diameter of both ends of the auxiliary power supply pin 250.

Thus, the auxiliary rings 261 and 262 may be fit around both ends of the auxiliary power supply pin 250 and then may be inserted into the power supply support 203' as illustrated in FIG. 12. Subsequently, the radiator 202 is assembled to the power supply support 203'/balun support 204' by electrically connecting one end of the auxiliary power supply pin 250 to the air bridge through soldering. Referring to FIG. 13, the other end of the auxiliary power supply pin 250 may be electrically connected to a cable core 331 of the power supply cable 330 through soldering.

As is apparent from the above description, the broadband dipole antenna of the present invention facilitates matching to a raydome, has broader-band characteristics, and can be designed so as to easily adjust desired impedance in a frequency band. Furthermore, the balun structure of the broadband dipole antenna allows easy fabrication and is stable.

While the present invention has been particularly shown and described with reference to embodiments thereof, it will be understood by those of ordinary skill in the art that various changes in form and details may be made therein without departing from the spirit and scope of the present invention. For example, while it has been described above that the radiation patterns of the present invention are square ring-shaped, they may be formed into many other shapes such as a square, a circle, etc. Aside from the embodiments of the present invention as set forth herein, various other embodiments of the present invention may be contemplated. Therefore, the scope of the present invention should be defined by the following claims and their equivalents, rather than by the above-described embodiments.

The invention claimed is:

1. A broadband dipole antenna comprising:

a radiator including a plurality of radiation pattern units for transmitting and receiving a radio signal, the radiation pattern units having radiation patterns of resonators formed thereon; and a power supply and balun structure for supporting and supplying power to the radiator, wherein the plurality of radiation pattern units of the radiator together constitutes at least a dual radiation pattern structure having an inner radiation pattern and an outer radiation pattern, and the outer radiation pattern generates oscillation having a low-frequency band that is preset from a broadband, the inner radiation pattern generates oscillation having a high-frequency band that is preset from the broadband, and a width, length, and shape of each of the plurality of radiation units are set to generate, as a whole, frequency characteristics corresponding to a combination of the oscillation having the low-frequency band and the oscillation having the high-frequency band.

2. The broadband dipole antenna of claim 1, wherein the radiation patterns of the plurality of radiation pattern units are shaped into at least one of a square, a square ring, and a circle and have a predetermined width, length, and shape.

3. The broadband dipole antenna of claim 1, further comprising a broadband compensation pad formed at a center of the other surface of the radiator.

4. The broadband dipole antenna of claim 1, wherein the power supply and balun structure includes a power supply cable and a balun cable, for supporting the radiator.

5. The broadband dipole antenna of claim 1, wherein the power supply and balun structure comprises a power cable and balun support that is formed by integrating a plurality of pipes each having a diameter equal to a diameter of a power supply cable, is fixed to a reflection plate at a lower end portion thereof, and is electrically connected to the plurality of radiation pattern units of the radiator at an upper end portion thereof, wherein the power cable is inserted into a predetermined one of the plurality of pipes.

6. The broadband dipole antenna of claim 1, wherein the power supply and balun structure comprises:

a power cable and balun support that is formed by integrating a plurality of pipes each having a diameter equal to a diameter of a power supply cable, is fixed to a reflection plate at a lower end portion thereof, and is electrically connected to the plurality of radiation pattern units of the radiator at an upper end portion thereof; and an auxiliary power supply device inserted into a predetermined one of the plurality of pipes and thus connected to a power cable at one end thereof and connected to the radiator at the other end thereof, for forming a power supply path.

7. The broadband dipole antenna of claim 6, wherein the auxiliary power supply device comprises:

an auxiliary power supply pin having one end connected to the power supply cable and the other end connected to the radiator, for forming the power supply path; and an auxiliary ring for supporting the auxiliary power supply pin and isolating the auxiliary power supply pin from an inner surface of the pipe.

* * * * *